United States Patent [19]

Walsh

[11] 4,434,617

[45] Mar. 6, 1984

[54] START-UP AND CONTROL METHOD AND APPARATUS FOR RESONANT FREE PISTON STIRLING ENGINE

[75] Inventor: Michael M. Walsh, Schenectady, N.Y.

[73] Assignee: Mechanical Technology Incorporated, Latham, N.Y.

[21] Appl. No.: 402,303

[22] Filed: Jul. 27, 1982

[51] Int. Cl.[3] ..... F02G 1/06

[52] U.S. Cl. ..... 60/520; 60/518; 62/6

[58] Field of Search ..... 60/517, 518, 520, 525; 62/6

[56] References Cited

U.S. PATENT DOCUMENTS

| | | | |
|---|---|---|---|
| 4,215,548 | 8/1980 | Beremand | 60/520 |
| 4,345,437 | 10/1982 | Dineen | 60/520 X |
| 4,361,008 | 11/1982 | Dineen | 60/520 X |
| 4,389,849 | 6/1983 | Gasser et al. | 62/6 |

*Primary Examiner*—Allen M. Ostrager
*Assistant Examiner*—Stephen F. Husar
*Attorney, Agent, or Firm*—Joseph V. Claeys; Arthur N. Trausch, III

[57] ABSTRACT

A resonant free-piston Stirling engine having a new and improved start-up and control method and system. A displacer linear electrodynamic machine is provided having an armature secured to and movable with the displacer and having a stator supported by the Stirling engine housing in juxtaposition to the armature. A control excitation circuit is provided for electrically exciting the displacer linear electrodynamic machine with electrical excitation signals having substantially the same frequency as the desired frequency of operation of the Stirling engine. The excitation control circuit is designed so that it selectively and controllably causes the displacer electrodynamic machine to function either as a generator load to extract power from the displacer or the control circuit selectively can be operated to cause the displacer electrodynamic machine to operate as an electric drive motor to apply additional input power to the displacer in addition to the thermodynamic power feedback to the displacer whereby the displacer linear electrodynamic machine also is used in the electric drive motor mode as a means for initially starting the resonant free-piston Stirling engine.

10 Claims, 3 Drawing Figures

START-UP AND CONTROL METHOD AND APPARATUS FOR RESONANT FREE PISTON STIRLING ENGINE

The Government of the United States of America has rights in this invention pursuant to Contract No. DEN3-56 awarded by U.S. Department of Energy.

TECHNICAL FIELD

This invention relates to resonant free-piston Stirling engines, where resonant is meant to indicate operation at substantially the natural oscillation frequency of the engine system.

More specifically, the invention relates to a new and improved control method and apparatus for reliably controlling power output from Stirling engines of the free-piston type and which facilitates reliable, initial start-up of such engines.

BACKGROUND PRIOR ART

U.S. Pat. No. 4,215,548—issued Aug. 5, 1980, for a "Free-Piston Regenerative Hot Gas Hydraulic Engine", discloses a free-piston Stirling engine construction, which, while it is not a resonant free-piston Stirling engine, is highly instructive as to the measures which have been undertaken with respect to free-piston Stirling engines in order to control their operation and control output power. The engine described in U.S. Pat. No. 4,215,548 requires the use of an external drive system for the displacer and this external drive system may employ pneumatic, electromagnetic or hydraulic subsystems to provide the externally applied driving forces for the displacer. FIG. 4 of U.S. Pat. No. 4,215,548 illustrates an embodiment which employs an electromagnetically operated solenoid for applying the external forces for driving the displacer.

The present invention is to be contrasted to the free-piston Stirling engine disclosed in FIG. 4 of U.S. Pat. No. 4,215,548 in that it is a resonant free-piston Stirling engine wherein at least partial displacer power is derived from the thermodynamic cycle of the engine, and the output power derived from the engine is controlled by adjusting the displacer phase angle relative to the phase angle of the working member (power piston) of the engine by either applying power to or extracting power from the displacer externally.

SUMMARY OF INVENTION

It is therefore a primary object of the invention to provide a new and improved control method and apparatus for controlling power output developed by a resonant free-piston Stirling engine.

Another object of the invention is to provide such a control method and apparatus which also facilitates reliable, initial start-up of resonant free-piston Stirling engines.

In practicing the invention, an improved method and apparatus of controlling operation of a resonant free-piston Stirling engine, are provided. The Stirling engines are of the type having a heating vessel for heating a charge of working gas enclosed within a working space formed in the Stirling engine housing. The working gas is heated by the vessel at one end of the working space and cooled by a cooler at the other end. The working gas is shuttled back and forth from the heated end to the cooled end of the working space by a displacer which reciprocates axially within the Stirling engine housing to generate a periodic pressure wave in the working gas at the desired frequency of operation for the engine. The periodic pressure wave acts upon and drives a working member which may be in the form of a power piston or a diaphragm or the like to derive output power from the engine. A displacer linear electrodynamic machine is provided and comprises an armature secured to and movable with the displacer and a stator supported by the Stirling engine housing in juxtaposition to the armature. The displacer linear electrodynamic machine is a general purpose machine capable of operation either as a linear electric motor or as a linear electric generator. The improved control method and apparatus comprises means for electrically exciting the displacer linear electrodynamic machine with electrical excitation signals at the same frequency as the desired operating frequency for the Stirling engine but in an adjustable phase relationship with the motion of the working member. The electrical control method and means includes means for selectively and controllably causing the displacer linear electrodynamic machine to function as a generator load to extract power from the displacer under conditions where it is desired to reduce output power of the Stirling engine. As a result, the displacer is caused to move with reduced stroke and/or greater phase angle relative to the working member (power piston) of the Stirling engine and the thermodynamic engine operation is dampened to reduce the engine output power. Alternatively, the control method and means can selectively and controllably cause the displacer linear electrodynamic machine to operate as an electric drive motor to apply additional input power to the displacer in addition to the thermodynamic power fed back to the displacer by the periodic pressure wave under conditions where it is desired to increase output power from the Stirling engine. While thus operated, the displacer is caused to move with increased stroke and/or a smaller phase angle relative to the working member (power piston) of the Stirling engine, and increased power output is derived from the engine.

A further feature of the invention is the provision of a method and means for using the displacer linear electrodynamic machine in the electric drive motor mode as a means for initially starting the resonant free-piston Stirling engine.

BRIEF DESCRIPTION OF DRAWINGS

These and other objects, features and many of the attendant advantages of this invention will become better understood upon a reading of the following detailed description when considered in connection with the accompanying drawings, wherein like parts in each of the several figures are identified by the same reference numeral; and wherein.

BEST MODE OF PRACTICING INVENTION

Figure 1:
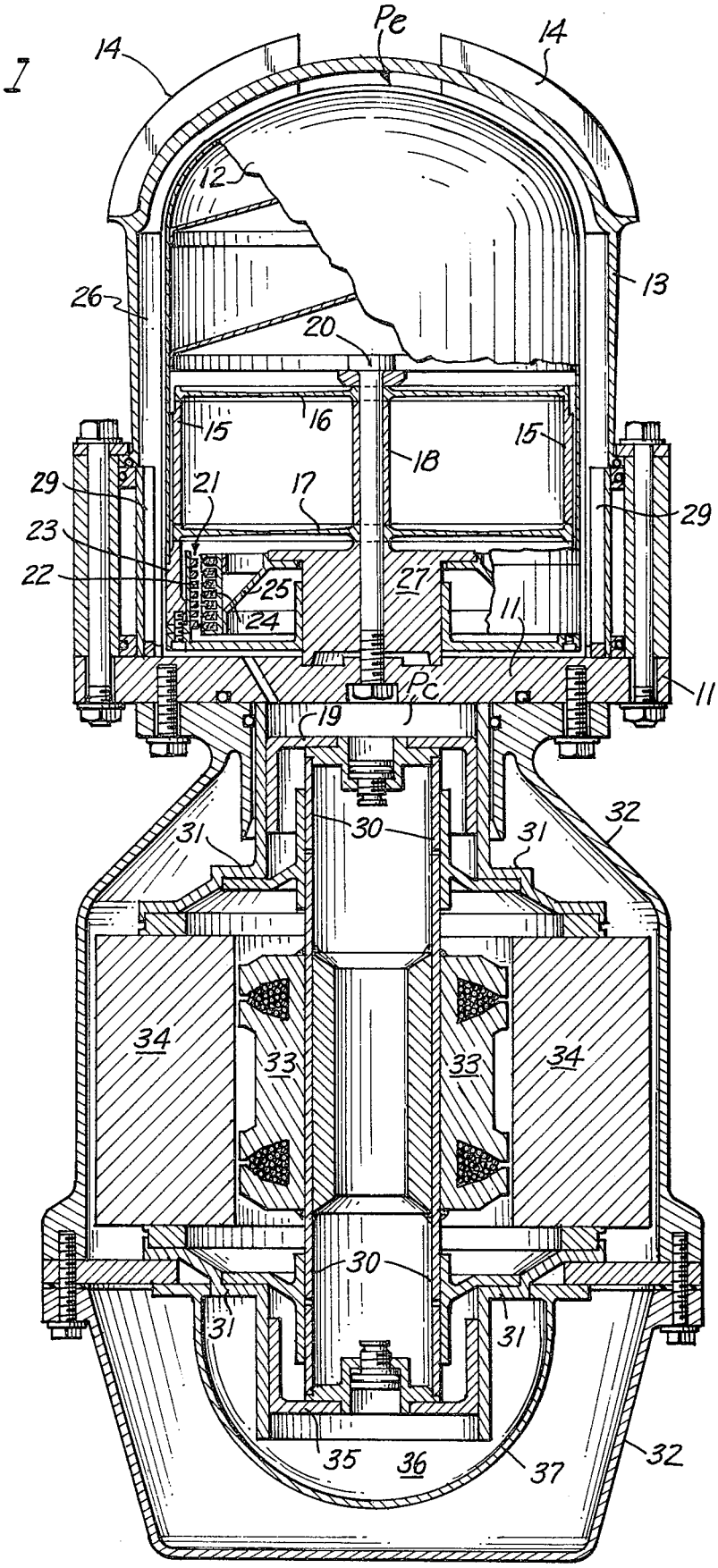
FIG. 1 is a longitudinal sectional view of a resonant free-piston Stirling engine having a new and improved start-up and control system constructed in accordance with the present invention.

FIG. 1 is a longitudinal sectional view of a resonant free-piston Stirling engine having a new and improved control system and method of operation for controlling output power developed by the engine and built in accordance with the invention. The resonant free-piston Stirling engine shown in FIG. 1 includes a housing 11 within which a displacer 12 is supported for reciprocal up-down movement within an exterior heating vessel 13 having heat exchanger fins 14 secured thereon through which hot gases flow from a heat source, such as a combustion chamber (not shown) or other sources of heat, eg. solar collector, supported over the top of the heating vessel 13. A suitable heat source (not shown) which may be used with the engine shown in FIG. 1 is disclosed in U.S. Ser. No. 172,373, Filed July 25, 1980—John J. Dineen, et. at.—inventors, entitled "Diaphragm Displacer Stirling Engine Powered Alternator-Compressor", now U.S. Pat. No. 4,380,152 and assigned to Mechanical Technology Incorporated. The heat exchanger heats the working gas which is trapped within the space between displacer 12 and the heating vessel or shell 13 by supplying hot gases of combustion that flow around the exterior of shell 13 and then are exhausted back out through exhaust ports of the heat exchanger during operation of the engine. The hot combustion gases thus supplied cause the working gas contained within the interior of vessel 13 to be continuously heated and expanded.

The displacer 12 includes an intermediate skirt portion 15 which is secured by means of an upper flexible diaphragm 16 and a lower flexible diaphragm 17 to a hollow center support post 18 fixed to the housing 11 with a central rod 20.

As noted previously, the working space within the Stirling engine contains a working gas that is heated and expanded in the upper heated end of the Stirling engine denoted by the space between the inside of heating vessel 13 and the outer surface of displacer 12 as indicated by the reference character $P_e$. This space communicates through narrow heat exchanger passageways extending downwardly along the inside of the vessel 13 through a suitable regenerator 26 and cooler 29 to a cool space where it is compressed as denoted by the reference character $P_c$. The working gas in the cool space $P_c$ is exposed to the top surface of a working member comprised by a power piston 19.

Figure 2:
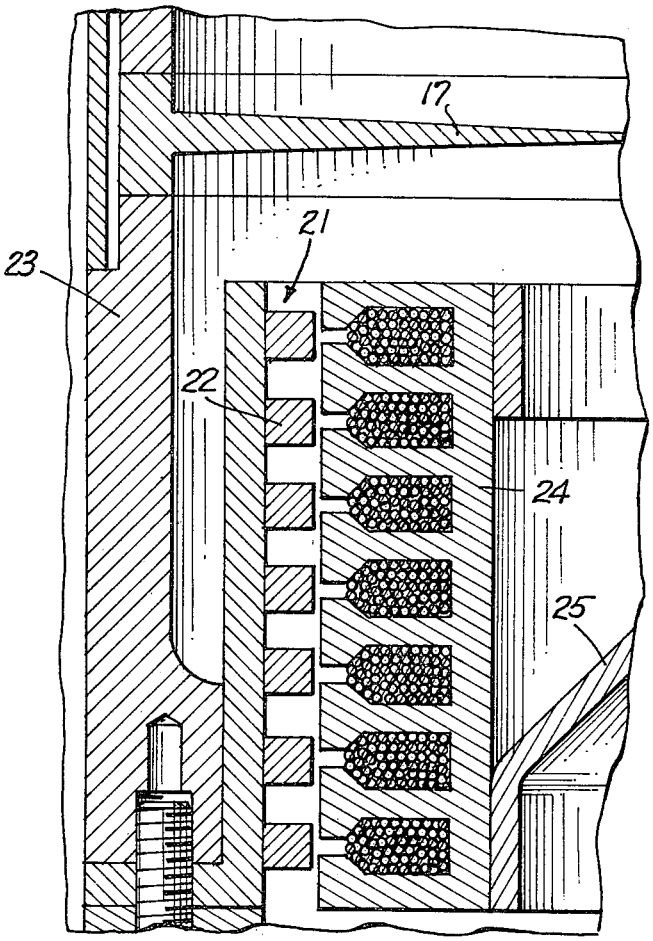
FIG. 2 is a partial, longitudinal sectional view of a portion of the Stirling engine shown in FIG. 1, and illustrates in detail the manner in which a displacer linear electrodynamic machine is mounted within the Stirling engine with the armature thereof secured to and movable with the displacer of the Stirling engine, and with the stator mounted on the engine housing in juxtaposition to the armature.

A displacer linear electrodynamic machine 21 has a permanent magnet movable armature 22 secured to the lower skirt portion 23 of displacer 12 as best shown in FIG. 2 of the drawings. Permanent magnet 22 which in the preferred embodiment is the armature is disposed opposite a set of windings 24 which are secured by support arms 25 to a lower enlarged diameter portion 27 of the center post 18. The permanent magnet, displacer linear electrodynamic machine 21 thus constructed, is otherwise of conventional construction and operation except for the mounting of the armature thereof on the displacer of the Stirling engine and may be generally of the same type and construction as the linear machine described more fully in U.S. Patent Application Ser. No. 168,716 Field July 14, 1980 in the name of Jeffrey S. Rauch for a "Free-Piston Stirling Engine Power Control", now U.S. Pat. No. 4,408,456 assigned to Mechanical Technology Incorporated, the disclosure of which is hereby incorporated into the disclosure of this application in its entirety.

The displacer linear electrodynamic machine 21 as described above is a general purpose machine capable of operation either as a linear electric motor or as a linear electric generator. The winding 24, which in the preferred embodiment is the stator, is excited from a source of alternating current having a frequency substantially equal to the desired frequency of operation of the Stirling engine. A suitable control circuit for this purpose is shown in FIG. 3 of the drawings.

Figure 3:
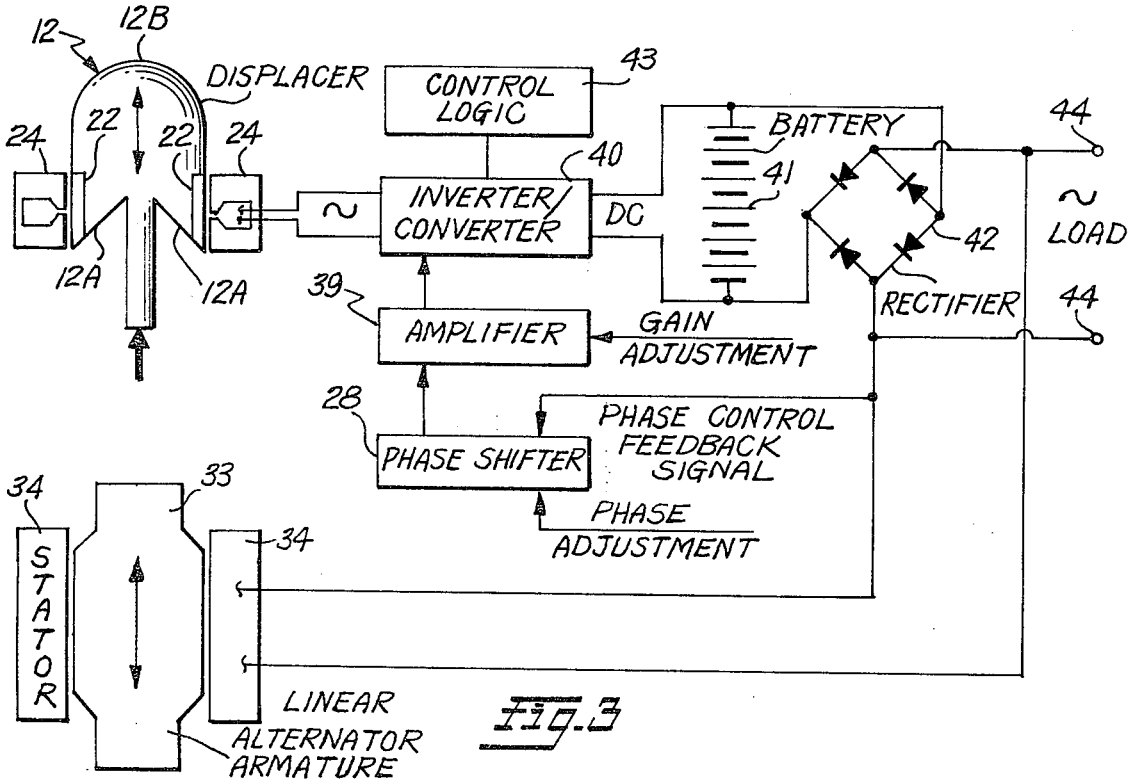
FIG. 3 is a functional schematic diagram illustrative of the control circuit for use with the displacer linear electrodynamic machine for selectively causing it to operate as an electric generator under conditions where it is desired to reduce power output from the Stirling engine of FIG. 1, or alternatively for selectively causing the displacer linear electrodynamic machine to operate as an electric drive motor for increasing power output of the Stirling engine.

In FIG. 3 the displacer is shown schematically at 12 having an armature 22 of the electrodynamic machine means 21 secured to the lower skirt. The armature 22 is juxtaposed to the stator windings 24 which in turn are connected to an inverter/converter 40 of known construction, whose characteristics will be described more fully hereafter. The thermodynamic power input to the displacer 12 is indicated by the enlarged arrow acting against the end of a rod-like area at the right end of the displacer. It will be noted that the physical configuration of the displacer depicted in FIG. 3 is somewhat different than that disclosed in FIG. 1 and is intended to depict a displacer having a post or rod which is acted upon by the periodic pressure wave produced in the Stirling enigne. This configuration has been employed in FIG. 3 for the purpose of illustrating that the invention is not restricted in its application to use with diaphragm supported displacers or any particular displacer configuration but may be employed generally in conjunction with the displacer of any resonant free-piston Stirling engine.

Power input to the displacer electrodynamic machine 21 is supplied via the inverter/converter 40 from a battery source of direct current power 41 that in turn may be kept charged from alternating current power tapped off from a linear alternator 33, 34 driven by the Stirling engine as will be described hereafter. The alternating current power generated by alternator 33, 34 is supplied through output terminals 44 to a suitable load and a portion thereof may be tapped off via a full wave rectifier bridge 42 and supplied back to battery 41 to keep battery 41 in a fully charged condition during operation. Operation of the inverter/converter 40 is controled via an amplifier 39 having a gain adjustment control input and a phase shifter 28 having a phase adjustment input. Phase shifter 28 is supplied with a signal level feedback signal proportional to the output derived from the linear alternator 33, 34 in order to synchronize operation of the inverter/converter 40, and hence operation of the displacer electrodynamic machine 21, whith the output alternating current power being generated by linear alternator 33, 34. If desired, the output terminal 44 may supply its power output to a power grid having other laternator/generator sets connected to it.

By changing the phase of the excitation signal supplied to the stator winding 24 via phase shifter 28, amplifier 39 and inverter/converter 40, it is possible to cause the linear electrodynamic machine 21 to apply a periodic force to the displacer which is adjustable relative to the periodic pressure wave in the engine. This allows the phase angle of the net displacer driving force, which is the vector sum of the displacer driving force due to the periodic pressure wave in the engine plus the force exerted by the displacer linear electrodynamic machine, to be adjusted relative to the motion of the working member. By increasing this relative phase angle, less power output will be produced by the engine. Alternatively, by appropriate adjustment of the phase of the excitation signal supplied to the stator winding 24 via the variable phase shifter 28, the displacer linear electrodynamic machine 21 can be operated as a drive motor which puts power into the displacer and causes it to move with a lesser relative phase angle with respect to the power piston 19. This in turn results in producing greater power output from the Stirling engine. Another mode of adjustment providing improved control over the operation of the resonant free-piston Stirling engine power output is available through the gain adjustment to amplifier 39. By appropriate adjustment of the amplitude of the excitation signals supplied from inverter/converter 40 to the displacer electrodynamic machine 21 leads, it is possible to adjust the stroke of the displacer to thereby control power output developed by the engine/alternator combination.

Various methods of control are possible with the same general arrangement discribed above and made available by the invention. For example, the power supplied to the displacer by the periodic engine pressure wave may be such that the displacer is over-driven. Under this condition, the displacer linear electrodynamic machine means will act as a continuous load, restraining the tendency to overstroke the displacer. Displacer stroke, and consequently engine power output can be continuously adjusted by modulating the power extracted from the displacer linear electrodynamic machine means. This is achieved by causing the inverter/converter 40 to operate in a power rectifier mode via a control logic circuit 43 built into the inverter/converter whereby during intervals while the displacer electrodynamic machine 21 is operating as an alternator, such condition is sensed by the control logic circuit 43 and the inverter/converter 40 switched to the power rectifier mode. The power generated thereby is rectified and supplied to battery 41 to keep it in a charged state. In a second example, the power supplied to the displacer by the periodic engine pressure wave may be such that the displacer is under-driven. Under such condition, the displacer linear electrodynamic machine 21 would supply some power to the displacer 12 to keep the engine operating. In this mode the engine output power directly follows the input power to the displacer linear electrodynamic machine since displacer stroke is a direct function in input power supplied to the displacer, and at a given phase angle engine output power is proportional to displacer stroke. In this second example, either phase control or stroke control as described above, or both may be used.

The power piston or working member 19 has secured to the under surface thereof a depending, central, hollow driveshaft member 30 which vibrates up and down with the movement of the power piston 19. Both power piston 19 and the depending central driveshaft 30 are journalled within suitable bearing surfaces formed in a lower housing portion 31 of the engine and are allowed to move freely within these bearing portions by reason of air bearings (not shown) which are designed into the appropriate bearing surfaces in a known manner. This entire structure is contained within a lower, outer housing 32 which also supports a load linear generator comprised by an armature 33 secured to and movable with the central driveshaft member 30. Armature 33 is physically disposed opposite the stator windings 34 of the load linear generator. Windings 34 are supported within the outer housing member 32 by the lower housing members 31 in juxtaposition to the armature 33. It should be noted that the particular design of the load linear generator 33, 34 is not a part of the present invention and hence any suitable linear electrical generator design could be employed in its place to be reciprocated by the power piston 19 and central driveshaft member 30. If desired, an entirely different type of load such as a linear air compressor of the type disclosed in U.S. Patent Application Ser. No. 168,716, now U.S. Pat. No. 4,408,456 referenced above, could be employed in place of the load linear electric generator 33, 34. Alternatively, a linear hydraulic pump, etc. could constitute the load being driven by power piston 19, central driveshaft member 30. In either of these examples the phase control feedback signal supplied to phase shifter 28 in FIG. 3 would have to be provided by a suitable signal transducer coupled to sense the stroke of the engine output member and derive a suitable feedback signal representative of its magnitude.

The power piston 19 and central load driveshaft 30 have a lower power piston 35 secured to the lower end of the central driveshaft 30. The lower power piston 35 operates into an enclosed bounce space 36 formed by an enclosure member 37 secured to the lower frame members 31 and forming a gas-tight enclosure over the lower power piston surface 35 providing a gas spring. The gas spring in combination with 19, 30, 33 and 35 form a spring-mass system having a natural frequency substantially the same as the operating frequency of the engine.

In operation, the Stirling engine/generator assembly initially is started by placing the displacer linear electrodynamic machine 21 in the drive motor mode to drive the displacer 12 up and down. Simultaneously, thermodynamic input in the form of heat is applied to the outer surfaces of the heating vessel 13 via fins 14 and the combustor and heat exchanger portion of the engine (not shown). Heating of the working gas within the space denoted $P_e$ causes the gas to expand while the displacer 12 is driven downwardly by motor 21. Movement of the displacer 12 in the downward direction causes the gas in the working space labeled $P_c$ to be shuttled from this working space back up through the cooler and regenerator 26 and into the heated end of the engine where it is expanded due to the heat which increases internal engine pressure and further assists in driving the displacer 12 downwardly.

At the end of its downward travel, the spring effect of the two diaphragms 16 and 17, causes the direction of travel of displacer 12 to be reversed and thereafter driven upwardly. Subsequent continued movement of the displacer 12 in the upward direction causes the greater portion of the working gas in the space between the upper end of displacer 12 and heating vessel 13 to be moved downwardly via the interconnecting passageways through the regenerator 26 and cooler 29 removing heat and decreasing the pressure of the gas in the working space labeled $P_c$ and further aids in driving the displacer 12 upwardly until the displacer reaches the upper end of its travel where its direction of movement is again reversed in order to initiate a new cycle of reciprocation.

The periodic heating and cooling of the working gas in the working spaces of the Stirling engine produces a periodic pressure wave in the working space in the engine including the lower space labeled $P_c$ which acts upon the power piston 19 surface and causes it to be driven downwardly as the gas in the expansion space $P_e$ is heated. This in turn causes the central driveshaft 30 together with the armature 33 of the load generator 33 and 34 to be moved downwardly against the pressure of the bounce space 36. Upon power piston 19 and driveshaft 30 together with the lower piston 35 reaching the lower end of their downward travel, the energy stored as increased pressure in the bounce space 36 causes the power piston assembly to slow, stop and then to be returned back in the opposite upward direction recompressing engine cycle gas now in the compression space $P_c$. At the end of its upward movement, the reduction of pressure in gas spring volume 36 in conjunction with increasing pressure in the working space $P_c$ will again slow, stop and initiate return of the power piston assembly in the opposite downward direction thereby completing one cycle of reciprocation. This up-down motion results in changing the magnetic field threading the stator winding 34 of the load generator as a result in the change in physical positioning of the armature 33 thereby producing electrical power in the stator winding 34 for supply to a user of the output electric power being generated by the equipment.

For a more detailed explanation of the thermodynamics involved in the operation of a free-piston Stirling engine, reference is made to the textbook entitled, "Stirling Engines" by G. Walker, published by Clarendon Press-Oxford, England-1980 and in U.S. Patent Application Ser. No. 168,716 referenced above, particularly with regard to the portion of the specification dealing with FIG. 7 and the phasor diagrams of FIG. 8.

The power output derived from the engine/load combination is a direct function of the phase angle between the movement of the displacer and the movement of the power piston (working member). If it is desired to increase the power output from the generator 33, 34 the excitation signals supplied to the displacer linear electrodynamic machine 21 stator windings 24 are adjusted via the phase adjustment circuit 28 to cause the displacer electrodynamic machine 21 to operate at a lower relative phase angle between the displacer and power piston and correspondingly increasing power output developed by the engine and load generator. Conversely, if it is desired to reduce the power output being developed by the load generator 33, 34, the phase control 28 of the displacer linear electrodynamic machine 21 excitation circuit is selectively operated to cause the electrodynamic machine 21 to function at an increased phase angle between movement of the displacer and the power piston and reducing power output from the equipment. Alternatively, its possible to achieve a similar increase or decrease in power output by adjustment of the displacer stroke via the amplifier 39 gain adjustment and the displacer electrodynamic machine 21.

From the foregoing description, it will be appreciated that the invention provides a new and improved control method and apparatus for controlling power output from Stirling engines of the resonant free-piston type and which facilitates reliable, initial start-up of such engines. While operating a resonant free-piston Stirling engine using the present invention, at least partial displacer driving power may be derived from the thermodynamic cycle of the engine, and the output power derived from the engine is controlled by turning the displacer phase angle relative to the phase angle of the working member (power piston) of the engine by either applying power to or extracting power from the displacer externally. Alternatively, control of power output can be obtained by adjustment of the displacer stroke via the displacer electrodynamic machine 21.

INDUSTRIAL APPLICABILITY

This invention relates to resonant free-piston Stirling engines and combination power packages employing such engines as the primary mover for use as electrical generators, compressors, hydraulic pumps and other similar apparatus useful in residential, commercial and industrial applications.

Having described one embodiment of a new and improved start-up and control method and apparatus for resonant free-piston Stirling engines constructed in accordance with the invention together with new and improved resonant free-piston Stirling engines employing the novel start-up and control method and apparatus, it is believed obvious that changes may be made in the particular embodiment of the invention described by those skilled in the art in the light of the above teachings. It is therefore to be understood that all such changes, additions and deletions are believed to come within the full intended scope of the invention, as defined by the appended claims.

What is claimed is:

1. A resonant free-piston Stirling engine of the type having a displacer reciprocally movable within an engine housing and at least partially driven by a working gas pressure wave periodically produced within the engine to drive a working member from which work is derived from the engine, the improvement including in combination, displacer linear electrodynamic machine means operatively associated with said displacer, said displacer linear electrodynamic machine means being a general purpose machine capable of selective operation either as a linear electric motor to partially driven said displacer in conjunction with the periodic working gas pressure wave or as a linear electric generator providing a load on said displacer.

2. A resonant free-piston Stirling engine of the type having a displacer reciprocally movable within an engine housing and at least partially driven by a working gas pressure wave periodically produced within the engine to drive a working member coupled to said displacer through coupling means constructed and arranged with respect thereto, from which work is derived from the engine, the improvement including in combination displacer linear electrodynamic machine means operatively associated with said displacer, armature means for said electrodynamic machine means secured to and movable with said displacer, stator means for said electrodynamic machine means supported by said engine housing in juxtaposition to said armature means, and means for electrically exciting said displacer linear electrodynamic machine means with electrical excitation signals whereby the phase angle of movement of the displacer relative to the movement of said working member can be modified during operation of the engine.

3. A resonant free-piston Stirling engine having a new and improved start-up and control system including in combination a displacer reciprocally movable within the Stirling engine housing and exposed to a working gas pressure wave periodically produced within the Stirling engine to drive a working member from which work is derived from the engine, displacer linear electrodynamic machine means having an armature secured to and movable with the displacer and having a stator supported by the Stirling engine housing in juxtaposition to said armature, said displacer linear electrodynamic machine means being a general purpose machine capable of operation either as a linear electric motor or as a linear electric generator, means for electrically exciting the displacer linear electrodynamic machine means with electrical excitation signals having substantially the same frequency as the frequency of operation of the Stirling engine, and selectively operable electric control means for selectively and controllably causing said displacer linear electrodynamic machine means to function either as a generator load to extract power from the displacer whereby the displacer is caused to move with a greater phase angle relative to the working member of the Stirling engine and thermodynamic engine operation is dampened to reduce output power from the engine, or, alternatively, selectively causing the displacer electrodynamic machine means to operate as an electric drive motor to apply additional input power to the displacer whereby the displacer is caused to move with a smaller phase angle relative to the working member and increased power output is derived from the engine.

4. A resonant free-piston Stirling engine according to claim 1, further including spring means acting on said displacer such that a spring-mass system is formed which has a natural frequency of oscillation that corresponds substantially to the operating frequency of the engine.

5. A resonant free-piston Stirling engine according to claim 4, wherein the displacer linear electrodynamic machine means also serves as a means for initially starting the resonant free-piston Stirling engine while operating in the electric drive motor mode.

6. An improved method of controlling operation of a resonant free-piston Stirling engine of the type having a heated vessel for heating a charge of working gas enclosed within a working space formed in the Stirling engine housing and which further includes the interior of the vessel, said working gas being heated by the vessel at one end of the working space and cooled by a cooler at the other end, the working gas being shuttled back and forth from the heated end to the cooled end of the working space by a displacer which reciprocates axially within the Stirling engine housing to generate a periodic pressure wave in the working gas at the resonant frequency of operation of the Stirling engine, the periodic pressure wave acting upon and driving a working member to derive output power from the engine, and displacer linear electrodynamic machine means having armature means secured to and moveable with the displacer and having stator means supported by the Stirling engine housing in juxtaposition to said armature, said displacer linear electrodynamic machine means being a general purpose machine capable of operation either as a linear electric motor or as a linear electric generator; the improved method comprising exciting the displacer linear electrodynamic machine means with electrical excitation signals having substantially the same frequency as the desired frequency of operation of the Stirling engine, selectively controlling excitation of said displacer linear electrodynamic machine means to cause it to operate as a generator load to extract power from the displacer and thereby cause the displacer to move with a greater phase angle relative to the working member of the Stirling engine under conditions where it is desired to decrease power output of the Stirling engine, and selectively controlling excitation of the displacer linear electrodynamic machine means to cause it to operate as an electric drive motor to apply additional input power to the displacer and thereby cause the displacer to move with a smaller phase angle relative to the working member under conditions where it is desired to increase power output from the Stirling engine.

7. The method according to claim 6, further including using the displacer linear electrodynamic machine means in the electric motor driving mode to initially start the resonant free-piston Stirling engine.

8. The method according to claim 7, further including springing the displacer to ground via the Stirling engine housing through an effective spring action on the displacer such that a resonant spring-mass system is formed having a natural frequency of oscillation that corresponds substantially to the operating frequency of the engine.

9. A resonant free-piston Stirling engine having a new and improved start-up and control system including in combination a vessel for heating a charge of working gas enclosed within a working space formed in the Stirling engine housing and including the interior of the vessel, said working gas being heated by the vessel at one end of the working space and cooled by a cooler at the other end, the working gas being shuttled back and forth from the heated end to the cooled end of the working space via a regenerator and cooler by a displacer which reciprocates axially within the Stirling engine housing to generate a periodic pressure wave in the working gas at the resonant frequency of operation of the Stirling engine, the periodic pressure wave acting upon and driving a working member reciprocally movable within the Stirling engine housing and from which output work from the engine is derived; the improvement comprising displacer linear electrodynamic machine means having an armature secured to and movable with the displacer and having a stator supported by the Stirling engine housing in juxtaposition to said armature, said displacer linear electrodynamic machine means being a general purpose machine capable of operation either as a linear electric motor or as a linear electric generator, means for electrically exciting the displacer linear electrodynamic machine means with electrical excitation signals having substantially the same frequency as the frequency of operation of the Stirling engine, and selectively operable electric control means for selectively and controllably causing said displacer linear electrodynamic machine means to function either as a generator load to extract power from the displacer whereby the displacer is caused to move with a greater phase angle relative to the working member of the Stirling engine and thermodynamic engine operation is dampened to reduce output power from the engine, or, alternatively, selectively causing the displacer electrodynamic machine means to operate as an electric drive motor to apply additional input power to the displacer whereby the displacer is caused to move with a smaller phase angle relative to the working member and increased power output is derived from the engine.

10. A resonant free-piston Stirling engine according to claim 9, wherein the displacer linear electrodynamic machine means also serves as a means for initially starting the resonant free-piston Stirling engine while operating in the electric drive motor mode and further including spring means acting on said displacer such that a spring-mass system is formed having a natural frequency of oscillation that corresponds substantially to the operating frequency of the engine.

* * * * *